US010597949B2

(12) United States Patent
Nielsen et al.

(10) Patent No.: US 10,597,949 B2
(45) Date of Patent: Mar. 24, 2020

(54) DRILLING COMPONENT

(71) Applicant: Materion Corporation, Mayfield Heights, OH (US)

(72) Inventors: William D. Nielsen, Houston, TX (US); Diane M. Nielsen, Houston, TX (US); Christopher Damschroder, Elmore, OH (US); Fritz C. Grensing, Perrysburg, OH (US)

(73) Assignee: MATERION CORPORATION, Mayfield Heights, OH (US)

( * ) Notice: Subject to any disclaimer, the term of this patent is extended or adjusted under 35 U.S.C. 154(b) by 0 days.

(21) Appl. No.: 14/581,521

(22) Filed: Dec. 23, 2014

(65) Prior Publication Data

US 2015/0267477 A1 Sep. 24, 2015

Related U.S. Application Data

(60) Provisional application No. 61/969,424, filed on Mar. 24, 2014.

(51) Int. Cl.
*E21B 17/00* (2006.01)
*C22C 9/06* (2006.01)

(52) U.S. Cl.
CPC ..... *E21B 17/00* (2013.01); *C22C 9/06* (2013.01)

(58) Field of Classification Search
CPC ..... E21B 17/04; E21B 17/042; E21B 19/18; E21B 17/00
See application file for complete search history.

(56) References Cited

U.S. PATENT DOCUMENTS

| | | | | |
|---|---|---|---|---|
| 4,641,976 | A * | 2/1987 | Kar | 384/95 |
| 4,772,246 | A | 9/1988 | Wenzel | |
| 6,371,224 | B1 | 4/2002 | Wellman | |
| 7,360,609 | B1 | 4/2008 | Falgout, Sr. | |
| 2002/0007879 | A1 | 1/2002 | Nielsen, Jr. et al. | |
| 2002/0122722 | A1 | 9/2002 | Bertin et al. | |
| 2004/0174017 | A1* | 9/2004 | Brill | E21B 17/042 285/333 |
| 2006/0225891 | A1* | 10/2006 | Adams et al. | 166/382 |
| 2009/0275415 | A1 | 11/2009 | Prill et al. | |

FOREIGN PATENT DOCUMENTS

| | | | |
|---|---|---|---|
| RU | 2508415 | C2 | 2/2014 |
| WO | WO 96/41033 | A1 | 12/1996 |
| WO | WO 2011/005403 | A1 | 1/2011 |
| WO | WO 2012/039700 | A1 | 3/2012 |
| WO | WO 2014/176357 | A1 | 10/2014 |

OTHER PUBLICATIONS

International Search Report and Written Opinion for PCT Application Serial No. PCT/US2014/072191.

* cited by examiner

*Primary Examiner* — Kristyn A Hall
(74) *Attorney, Agent, or Firm* — Fay Sharpe LLP

(57) ABSTRACT

A drilling component includes a spinodally-hardened copper-nickel-tin alloy. The drilling component may be a drill stem or a drill string component, such as a tool joint used for joining pipe together.

20 Claims, 3 Drawing Sheets

DRILLING COMPONENT

CROSS-REFERENCE TO RELATED APPLICATIONS

This application claims priority to U.S. Provisional Patent Application Ser. No. 61/969,424, filed on Mar. 24, 2014. That application is hereby fully incorporated by reference.

BACKGROUND

The present disclosure relates to drilling components including copper alloys.

Most copper alloys are unsuitable for use in drill string components, especially outer components such as heavy-section outer components that sustain impact loads and are in contact with the well bore during use. Copper alloys are believed to be unsuitable because they are known to be susceptible to fracture when subjected to strain at high rates (i.e., impact loading).

In addition, drill string components are often held together by threaded connections. The drill string components can be rendered unusable when the threaded connection segments are irreparably damaged due to galling. Galling occurs due to friction and/or adhesion between surfaces sliding relative to each other, for example by the metal-to-metal contact between the thread of one component and the thread of a second component, with material being transferred from one component to the other.

It would be desirable to develop new drilling components having extended lifetimes.

BRIEF DESCRIPTION

The present disclosure relates to drilling components including spinodally-hardened copper-nickel-tin alloys. The components provide a unique combination of properties including strength (e.g., tensile, compression, shear, and fatigue), ductility, high strain rate fracture toughness, galling protection, magnetic permeability, and resistance to chloride stress corrosion cracking. This delays the occurrence of destructive damage to drill string components while providing mechanical functionality during wellbore drilling operations. This also extends the useful service life of such components, significantly reducing the costs of equipment used to drill and complete oil and gas wells.

Disclosed in embodiments is a drilling component including a spinodally-hardened copper-nickel-tin alloy.

The copper-nickel-tin alloy may contain from about 8 to about 20 wt % nickel, and from about 5 to about 11 wt % tin, the remaining balance being copper. In more specific embodiments, the copper-nickel-tin alloy comprises about 14.5 wt % to about 15.5 wt % nickel, and about 7.5 wt % to about 8.5% tin, the remaining balance being copper.

The drilling component may be a drill stem, a tool joint, a drill collar, or a drillpipe.

In some embodiments, the drilling component has been cold worked and then reheated to affect spinodal decomposition of the microstructure.

The drilling component can have an outer diameter of at least about 4 inches. The drilling component may have a length of 60 inches or less. The drilling component generally has a bore that passes through the component from a first end to a second end of the component. The bore can have a diameter of about 2 inches or greater. A sidewall of the component may have a thickness of about 1.5 inches or greater.

In some embodiments, the drilling component has a male connector extending from a first end of a main body and a female connector extending into a second end of the main body. In other embodiments, the drilling component has a male connector extending from a first end of a main body and a male connector extending from a second end of the main body. In other different embodiments, the drilling component has a female connector extending into a first end of a main body and a female connector extending into a second end of the main body.

The drilling component can have a 0.2% offset yield strength of at least 120 ksi and a Charpy V-notch impact energy of at least 12 ft-lbs at room temperature. In other embodiments, the drilling component has a 0.2% offset yield strength of at least 102 ksi and a Charpy V-notch impact energy of at least 17 ft-lbs at room temperature. In still other embodiments, the drilling component has a 0.2% offset yield strength of at least 95 ksi and a Charpy V-notch impact energy of at least 22 ft-lbs at room temperature.

Alternatively, the drilling component may have an ultimate tensile strength of at least 160 ksi, a 0.2% offset yield strength of at least 150 ksi, and an elongation at break of at least 3%. In other embodiments, the drilling component may have an ultimate tensile strength of at least 120 ksi, a 0.2% offset yield strength of at least 110 ksi, and an elongation at break of at least 15%. In still different embodiments, the drilling component has an ultimate tensile strength of at least 106 ksi, a 0.2% offset yield strength of at least 95 ksi, and an elongation at break of at least 18%.

In particular embodiments, the drilling component has an ultimate tensile strength of at least 100 ksi, a 0.2% offset yield strength of at least 85 ksi, and an elongation at break of at least 10%. The drilling component may also have a Charpy V-Notch impact strength of at least 10 ft-lbs.

Disclosed in other embodiments is a drill stem including a spinodally-hardened copper-nickel-tin alloy. The copper-nickel-tin alloy may contain from about 8 to about 20 wt % nickel, from about 5 to about 11 wt % tin, and a balance of copper.

Disclosed in further embodiments is a drill string including a first component, and second component, and a drill string component. The drill string component is located between the first component and the second component. The drill string component includes a spinodally-hardened copper-nickel-tin alloy. A bore extends through the first component, the drill string component, and the second component.

These and other non-limiting characteristics of the disclosure are more particularly disclosed below.

BRIEF DESCRIPTION OF THE DRAWINGS

The following is a brief description of the drawings, which are presented for the purposes of illustrating the exemplary embodiments disclosed herein and not for the purposes of limiting the same.

DETAILED DESCRIPTION

Figure 1:
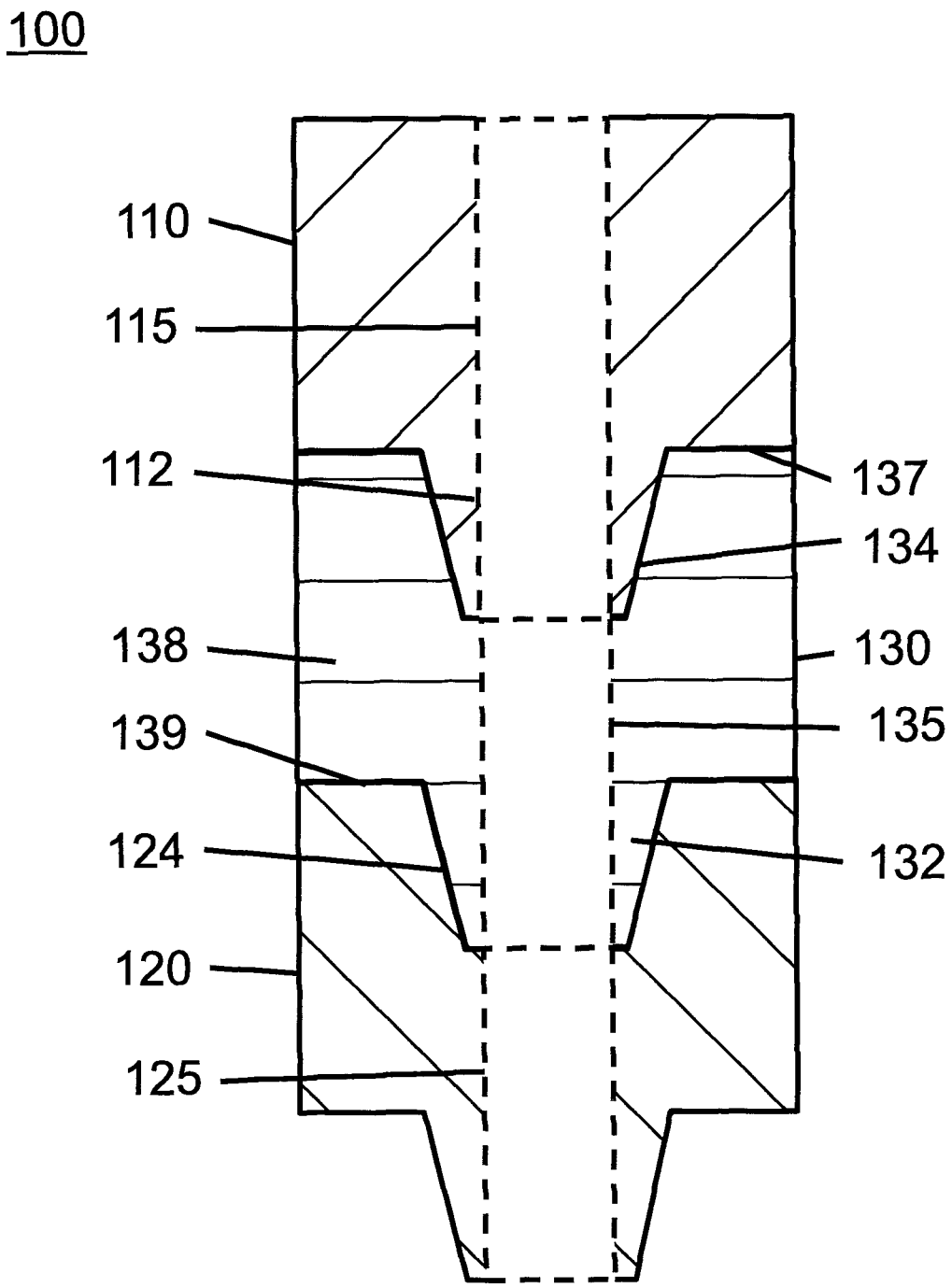
FIG. 1 is a cross-sectional view of a portion of a first embodiment of a drill string of the present disclosure.

A more complete understanding of the components, processes and apparatuses disclosed herein can be obtained by reference to the accompanying drawings. These figures are merely schematic representations based on convenience and the ease of demonstrating the present disclosure, and are, therefore, not intended to indicate relative size and dimensions of the devices or components thereof and/or to define or limit the scope of the exemplary embodiments.

Although specific terms are used in the following description for the sake of clarity, these terms are intended to refer only to the particular structure of the embodiments selected for illustration in the drawings, and are not intended to define or limit the scope of the disclosure. In the drawings and the following description below, it is to be understood that like numeric designations refer to components of like function.

The singular forms "a," "an," and "the" include plural referents unless the context clearly dictates otherwise.

As used in the specification and in the claims, the term "comprising" may include the embodiments "consisting of" and "consisting essentially of." The terms "comprise(s)," "include(s)," "having," "has," "can," "contain(s)," and variants thereof, as used herein, are intended to be open-ended transitional phrases, terms, or words that require the presence of the named ingredients/steps and permit the presence of other ingredients/steps. However, such description should be construed as also describing compositions or processes as "consisting of" and "consisting essentially of" the enumerated ingredients/steps, which allows the presence of only the named ingredients/steps, along with any impurities that might result therefrom, and excludes other ingredients/steps.

Numerical values in the specification and claims of this application should be understood to include numerical values which are the same when reduced to the same number of significant figures and numerical values which differ from the stated value by less than the experimental error of conventional measurement technique of the type described in the present application to determine the value.

All ranges disclosed herein are inclusive of the recited endpoint and independently combinable (for example, the range of "from 2 grams to 10 grams" is inclusive of the endpoints, 2 grams and 10 grams, and all the intermediate values).

A value modified by a term or terms, such as "about" and "substantially," may not be limited to the precise value specified. The approximating language may correspond to the precision of an instrument for measuring the value. The modifier "about" should also be considered as disclosing the range defined by the absolute values of the two endpoints. For example, the expression "from about 2 to about 4" also discloses the range "from 2 to 4."

The present disclosure relates to drilling components that are made from a spinodally strengthened copper-based alloy. The copper alloys of the present disclosure are copper-nickel-tin alloys that have a combination of strength, ductility, high strain rate fracture toughness, galling protection, magnetic permeability, and resistance to chloride stress corrosion cracking. This permits their use in making drilling components, including those used as outer components of a drill string that need to sustain impact loads. Such drilling components can include a drill stem, a tool joint, a drill collar, or a drill pipe. A drill stem is the last piece of tubing that connects the bottomhole assembly to the drill pipe. A tool joint is a component that is used at the ends of drill pipes to provide a connector that permits joining separate drill pipes together. The tool joint is usually fabricated separately from the pipe and is welded onto the drill pipe after fabrication. A drill collar is a component of the drill string that is used to provide weight to the bit for drilling. The drill collar is a tubular piece having a thick sidewall. A drill pipe is a hollow tube having a thick sidewall, which is used to facilitate the drilling of a wellbore. Drill pipe is designed to support its own weight over long distances.

FIG. 1 is a schematic diagram that illustrates a portion of a drill string 100 including a first component 110, a second component 120, and a drill string component 130 that connects the first component 110 and the second component 120 together. The first component 110 includes a male connector 112 that is received in a complementary recess 134 or female connector of the drill string component 130. The male connector 112 and the recess 134 are generally threaded. A male connector 132 of the drill string component 130 is received in a complementary recess or female connector 124 of the second component 120. Again, the male connector 132 and the recess 124 are generally threaded. Each component 110, 120, 130 includes a bore 115, 125, 135 that runs axially therethrough. For drill string component 130, the bore passes through the main body 138 and runs from a first end 137 to a second end 139 of the component. In this embodiment, the drill string component includes one male connector and one female connector on opposite ends of the component. The male connector 132 extends from the main body 138, and the female connector 134 extends into the main body 138.

Figure 2:
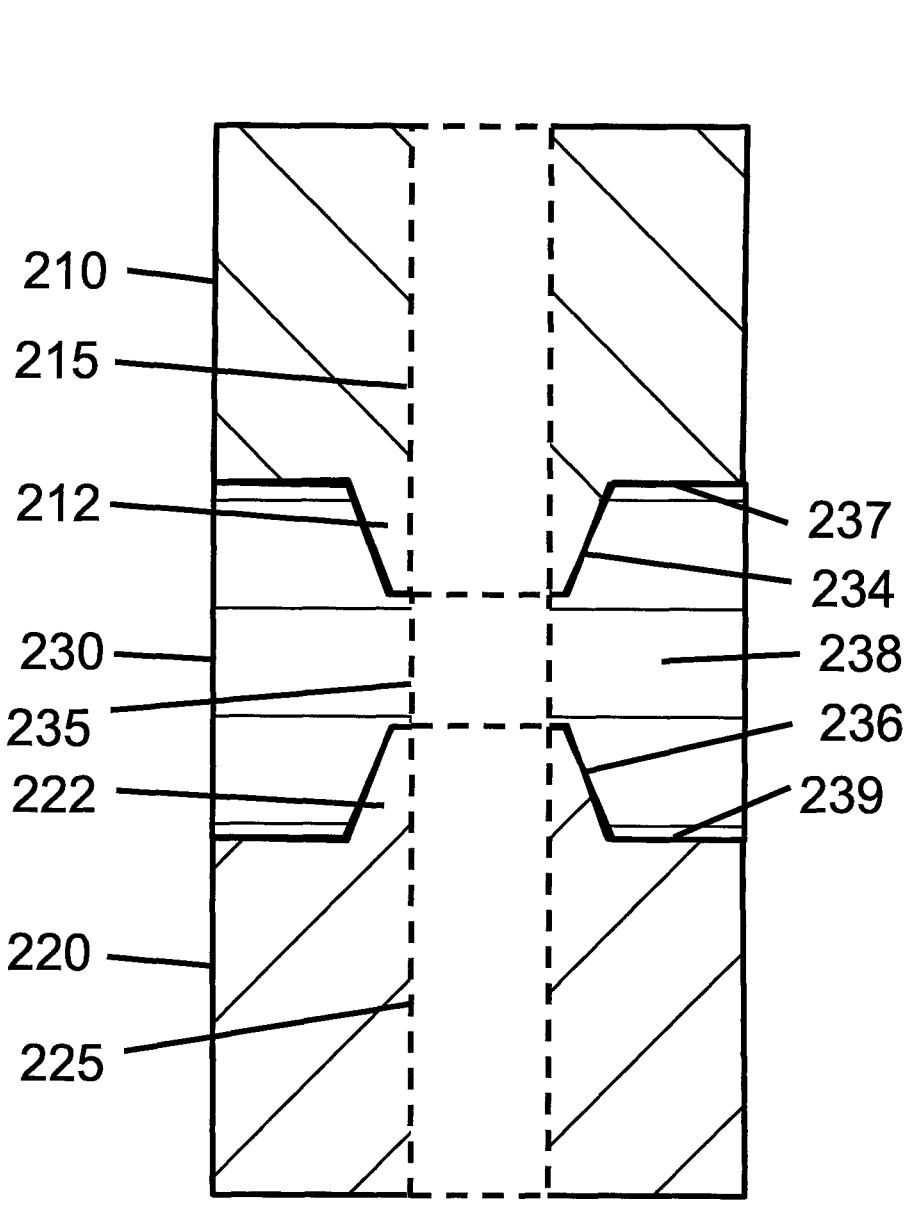
FIG. 2 is a cross-sectional view of a portion of a second embodiment of a drill string of the present disclosure.

FIG. 2 is a schematic diagram that illustrates a portion of a drill string 200 including a first component 210, a second component 220, and a drill string component 230 that connects the first component 210 and the second component 220 together. The first component 210 includes a male connector 212 that is received in a first complementary recess 234 or female connector of the drill string component 230. The male connector 212 and the recess 234 are generally threaded. A male connector 222 of the second component 220 is received in a second complementary recess or female connector 236 of the drill string component 230. Again, the male connector 222 and the recess 236 are generally threaded. Each component 210, 220, 230 includes a bore 215, 225, 235 that runs axially therethrough. For drill string component 230, the bore passes through the main body 238 and runs from a first end 237 to a second end 239 of the component. In this embodiment, the drill string component includes two female connectors located on opposite ends of the component. The female connectors 234 extend into the main body 238.

Figure 3:
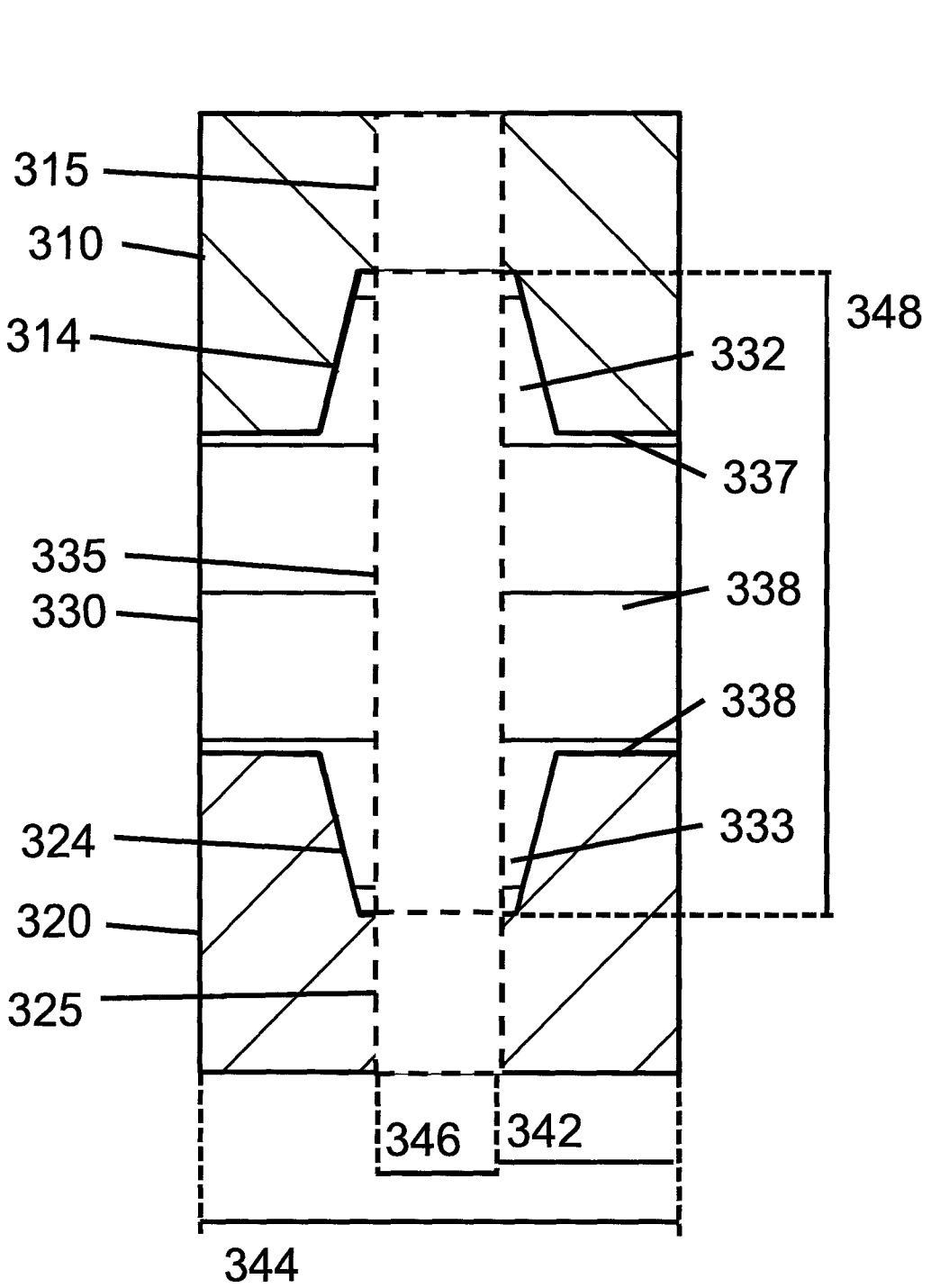
FIG. 3 is a cross-sectional view of a portion of a third embodiment of a drill string of the present disclosure.

FIG. 3 is a schematic diagram that illustrates a portion of a drill string 300 including a first component 310, a second component 320, and a drill string component 330 that connects the first component 310 and the second component 320 together. The first component 310 includes a female connector 314 that receives a first male connector 332 of the drill string component 330. The male connector 332 and the recess 312 are generally threaded. A second male connector 333 of the drill string component 330 is received in a complementary recess or female connector 324 of the drill string component 330. Again, the male connector 333 and the recess 324 are generally threaded. Each component 310, 320, 330 includes a bore 315, 325, 335 that runs axially therethrough. For drill string component 330, the bore passes through the main body 338 and runs from a first end 337 to a second end 339 of the component. In this embodiment, the drill string component includes two male connectors located on opposite ends of the component. The male connectors 132 extend from the main body 136, and the female connector 134 extends into the main body 136. The male connectors 332 extend from the main body 338.

Referring to FIG. 3 though applicable to all embodiments, the drill string 100, 200, 300 may be cylindrical or generally cylindrical and can have an outer diameter 344 of at least about 4 inches. The drill string component 130, 230, 330 can have a length 348 of 60 inches or less. the sidewall 340 surrounding the bore 335 has a thickness 342 of about 1.5 inches or greater. The bore 335 has a diameter 346 of about 2 inches or greater.

Generally, the copper alloy used to form the drilling component has been cold worked prior to reheating to affect spinodal decomposition of the microstructure. Cold working is the process of mechanically altering the shape or size of the metal by plastic deformation. This can be done by rolling, drawing, pressing, spinning, extruding or heading of the metal or alloy. When a metal is plastically deformed, dislocations of atoms occur within the material. Particularly, the dislocations occur across or within the grains of the metal. The dislocations over-lap each other and the dislocation density within the material increases. The increase in over-lapping dislocations makes the movement of further dislocations more difficult. This increases the hardness and tensile strength of the resulting alloy while generally reducing the ductility and impact characteristics of the alloy. Cold working also improves the surface finish of the alloy. Mechanical cold working is generally performed at a temperature below the recrystallization point of the alloy, and is usually done at room temperature.

Spinodal aging/decomposition is a mechanism by which multiple components can separate into distinct regions or microstructures with different chemical compositions and physical properties. In particular, crystals with bulk composition in the central region of a phase diagram undergo exsolution. Spinodal decomposition at the surfaces of the alloys of the present disclosure results in surface hardening.

Spinodal alloy structures are made of homogeneous two phase mixtures that are produced when the original phases are separated under certain temperatures and compositions referred to as a miscibility gap that is reached at an elevated temperature. The alloy phases spontaneously decompose into other phases in which a crystal structure remains the same but the atoms within the structure are modified but remain similar in size. Spinodal hardening increases the yield strength of the base metal and includes a high degree of uniformity of composition and microstructure.

Spinodal alloys, in most cases, exhibit an anomaly in their phase diagram called a miscibility gap. Within the relatively narrow temperature range of the miscibility gap, atomic ordering takes place within the existing crystal lattice structure. The resulting two-phase structure is stable at temperatures significantly below the gap.

The copper-nickel-tin alloy utilized herein generally includes from about 9.0 wt % to about 15.5 wt % nickel, and from about 6.0 wt % to about 9.0 wt % tin, with the remaining balance being copper. This alloy can be hardened and more easily formed into high yield strength products that can be used in various industrial and commercial applications. This high performance alloy is designed to provide properties similar to copper-beryllium alloys.

More particularly, the copper-nickel-tin alloys of the present disclosure include from about 9 wt % to about 15 wt % nickel and from about 6 wt % to about 9 wt % tin, with the remaining balance being copper. In more specific embodiments, the copper-nickel-tin alloys include from about 14.5 wt % to about 15.5% nickel, and from about 7.5 wt % to about 8.5 wt % tin, with the remaining balance being copper.

Ternary copper-nickel-tin spinodal alloys exhibit a beneficial combination of properties such as high strength, excellent tribological characteristics, and high corrosion resistance in seawater and acid environments. An increase in the yield strength of the base metal may result from spinodal decomposition in the copper-nickel-tin alloys.

The copper alloy may include beryllium, nickel, and/or cobalt. In some embodiments, the copper alloy contains from about 1 to about 5 wt % beryllium and the sum of cobalt and nickel is in the range of from about 0.7 to about 6 wt %. In specific embodiments, the alloy includes about 2 wt % beryllium and about 0.3 wt % cobalt and nickel. Other copper alloy embodiments can contain a range of beryllium between approximately 5 and 7 wt %.

In some embodiments, the copper alloy contains chromium. The chromium may be present in an amount of less than about 5 wt % of the alloy, including from about 0.5 wt % to about 2.0 wt % or from about 0.6 wt % to about 1.2 wt % of chromium.

In some embodiments, the copper alloy contains silicon. The silicon may be present in an amount of less than 5 wt %, including from about 1.0 wt % to about 3.0 wt % or from about 1.5 wt % to about 2.5 wt % of silicon.

The alloys of the present disclosure optionally contain small amounts of additives (e.g., iron, magnesium, manganese, molybdenum, niobium, tantalum, vanadium, zirconium, and mixtures thereof). The additives may be present in amounts of up to 1 wt %, suitably up to 0.5 wt %. Furthermore, small amounts of natural impurities may be present. Small amounts of other additives may be present such as aluminum and zinc. The presence of the additional elements may have the effect of further increasing the strength of the resulting alloy.

In some embodiments, some magnesium is added during the formation of the initial alloy in order to reduce the oxygen content of the alloy. Magnesium oxide is formed which can be removed from the alloy mass.

The alloys used for making the drilling components of the present disclosure can have a combination of 0.2% offset yield strength and room temperature Charpy V-Notch impact energy as shown below in Table 1. These combinations are unique to the copper alloys of this disclosure. The test samples used to make these measurements were oriented longitudinally. The listed values are minimum values (i.e. at least the value listed), and desirably the offset yield strength and Charpy V-Notch impact energy values are higher than the combinations listed here. Put another way, the alloys have a combination of 0.2% offset yield strength and room temperature Charpy V-Notch impact energy that are equal to or greater than the values listed here.

TABLE 1

| 0.2% Offset Yield Strength (ksi) | Room Temperature Charpy V-Notch Impact Energy (ft-lbs) | Preferred Room Temperature Charpy V-Notch Impact Energy (ft-lbs) |
|---|---|---|
| 120 | 12 | 15 |
| 102 | 17 | 20 |
| 95 | 22 | 30 |

Table 2 provides properties of one exemplary embodiment of a copper-based alloy suitable for the present disclosure for use in a drilling component.

TABLE 2

| | 0.2% Offset Yield Strength (ksi) | Ultimate Tensile Strength (ksi) | Elongation at break (%) | Charpy V-Notch Impact Energy (ft-lbs) |
|---|---|---|---|---|
| Average | 161 | 169 | 6 | N/A |
| Minimum | 150 | 160 | 3 | N/A |

Table 3 provides properties for another copper-based alloy suitable for use in a a drilling component.

TABLE 3

| | 0.2% Offset Yield Strength (ksi) | Ultimate Tensile Strength (ksi) | Elongation at break (%) | Charpy V-Notch Impact Energy (ft-lbs) |
|---|---|---|---|---|
| Average | 118 | 127 | 19 | 18 |
| Minimum | 110 | 120 | 15 | 12(15) |

Table 4 provides properties for yet another copper-based alloy suitable for use in a drilling component.

TABLE 4

| | 0.2% Offset Yield Strength (ksi) | Ultimate Tensile Strength (ksi) | Elongation at break (%) | Charpy V-Notch Impact Energy (ft-lbs) |
|---|---|---|---|---|
| Average | 105 | 115 | 22 | 60 |
| Minimum | 95 | 106 | 18 | 30(24) |

The drilling components of the present disclosure can be made using casting and/or molding techniques known in the art. Desirably, the drilling components conform to the requirements of API Specification 7 (reaffirmed December 2012) for non-magnetic drill string components, which specify minimum yield strength, tensile strength, and elongation at break values for the materials used to make the drilling component. Reference to the drilling component having certain values should be construed as referring to the material from which the drilling component is made More specifically, in some embodiments, the copper-based alloy has a 0.2% offset yield strength of at least 100 ksi, an ultimate tensile strength of at least 110 ksi, and an elongation at break of at least 20%. In other embodiments, the copper-based alloy has a 0.2% offset yield strength of at least 100 ksi, an ultimate tensile strength of at least 120 ksi, and an elongation at break of at least 18%. In additional embodiments, the copper-based alloy has a 0.2% offset yield strength of at least 110 ksi, an ultimate tensile strength of at least 120 ksi, and an elongation at break of at least 18%.

By delaying or preventing damage to the components of the drilling system, the useful life of the components is extended, thereby providing reduced costs of equipment used to drill and complete wells.

The following examples illustrate the alloys, articles, processes, and properties of the present disclosure. The examples are merely illustrative and are not intended to limit the disclosure to the materials, conditions, or process parameters set forth therein.

Examples

Four pieces were sawed to a length of 32 inches. These four pieces were designated A1A3, A1A4, A2A3, and A2A4. Each piece was then cut in half, and a letter A or B was added to the designation to refer to a given section of the piece, i.e. A1A3A and A1A3B. Next, each section was cold worked to a diameter of 5.25 inches and then machined to an outside diameter of 5.00 inches. The sections were then aged at 520° F. for three hours. Due to the size of the oven in which the aging was performed, the sections were separated into two different loads. All of the A sections were aged together, and all of the B sections were aged together.

Next, for each section, two samples were taken for tensile testing and three samples were taken for Charpy testing. Each section had a circular surface.

For the A sections, the two tensile samples were designated 2T and 3T. The samples were taken in the form of 0.75-inch squares, centered at a radius one inch from the outside surface. One sample was taken at a north end of the circular surface, and the other sample was taken at a south end of the circular surface. The three samples for Charpy testing were designated 2C, 3C1, and 3C2. These samples were taken in the form of 0.5-inch squares, centered at a radius one inch from the outside surface. The 2C sample was taken next to the 2T sample, the 3C1 sample was taken at an east end of the circular surface, and the 3C2 sample was taken next to the 3T sample.

For the B sections, the same five samples were taken, except that they were centered at a radius 1.5 inches from the outside surface.

Tensile data and Charpy testing data are reported in Tables 5A and 5B for the various sections.

TABLE 5A

| | | Tensile Data | | | | | | |
|---|---|---|---|---|---|---|---|---|
| | | Tensile Strength | 0.2% Offset Yield Strength | Elongation at break | Reduction of Area | Charpy V-Notch Impact Energy (ft-lbs) | | |
| Piece | Sample | (ksi) | (ksi) | (%) | (%) | 2C | 3C1 | 3C2 |
| A1A3A | 2T | 107.9 | 92.4 | 23.68 | 36.02 | 20 | 19 | 25 |
| A1A3A | 3T | 112.3 | 98.7 | 21.74 | 32.23 | | | |
| A1A4A | 2T | 112.4 | 99.4 | 15.41 | 43.32 | 26 | 23 | 32 |
| A1A4A | 3T | 108.5 | 95.8 | 20.08 | 43.49 | | | |
| A2A3A | 2T | 114.2 | 103.5 | 17.79 | 45.8 | 24 | 17 | 23 |
| A2A3A | 3T | 116.5 | 105.7 | 15.85 | 43.73 | | | |
| A2A4A | 2T | 108 | 94.1 | 21.69 | 37.16 | 18 | 32 | 24 |
| A2A4A | 3T | 108.6 | 95.1 | 20.7 | 44.09 | | | |

TABLE 5B

| | | Tensile Data | | | | | | |
|---|---|---|---|---|---|---|---|---|
| | | Tensile Strength | 0.2% Offset Yield Strength | Elongation at break | Reduction of Area | Charpy V-Notch Impact Energy (ft-lbs) | | |
| Piece | Sample | (ksi) | (ksi) | (%) | (%) | 2C | 3C1 | 3C2 |
| A1A3B | 2T | 106.4 | 92.9 | 23.39 | 40.63 | 21 | 22 | 22 |
| A1A3B | 3T | 106.3 | 92 | 25.62 | 36.66 | | | |
| A1A4B | 2T | 102.8 | 88.2 | 21.43 | 39.67 | 14 | 40 | 16 |
| A1A4B | 3T | 107.6 | 95.2 | 21.4 | 45.1 | | | |
| A2A3B | 2T | 113.6 | 102.4 | 18.57 | 46.56 | 14 | 21 | 13 |
| A2A3B | 3T | 117 | 104.3 | 20.38 | 41.47 | | | |
| A2A4B | 2T | 112 | 101.9 | 13.7 | 41.66 | 18 | 22 | 14 |
| A2A4B | 3T | 110 | 97.2 | 21.15 | 44.34 | | | |

The tensile strengths varied from 102 to 117 ksi. The yield strengths varied from 88 to 106 ksi. The elongation at break varied from 13% to 26%. The Charpy impact strengths varied from 13 to 40 ft-lbs.

Four additional pieces were designated B13, B14, B23, and B24. Each piece was then cut in half, and a letter A or B was added to the designation to refer to a given section of the piece, i.e. B13A and B13B. Samples were taken as described above, except each section was cold worked to a diameter of 7.12 inches and then machined to an outside diameter of 6.87 inches. Again, for the A sections, the samples taken were centered at a radius one inch from the outside surface. For the B sections, the samples taken were centered at a radius 1.5 inches from the outside surface.

Tensile data and Charpy testing data are reported in Tables 6A and 6B for the various sections.

TABLE 6A

| | | Tensile Data | | | | | | |
|---|---|---|---|---|---|---|---|---|
| | | Tensile Strength | 0.2% Offset Yield Strength | Elongation at break | Reduction of Area | Charpy V-Notch Impact Energy (ft-lbs) | | |
| Piece | Sample | (ksi) | (ksi) | (%) | (%) | 2C | 3C1 | 3C2 |
| B13A | 2T | 111.8 | 99.3 | 19.02 | 39.67 | | | |
| B13A | 3T | 119.3 | 109.1 | 10.66 | 34.75 | | | |
| B14A | 2T | 113.2 | 100.4 | 20.76 | 37.45 | 16 | 19 | 15 |
| B14A | 3T | 113.4 | 101.9 | 20.06 | 38.73 | | | |
| B23A | 2T | 126.8 | 116.6 | 12.49 | 31.09 | | 10 | 11 |
| B23A | 3T | 114.6 | 103.8 | 16.51 | 37.1 | | | |
| B24A* | 2T | 115.7 | 104.8 | 16.84 | 36.68 | 12 | 10 | 14 |
| B24A | 3T | 119.7 | 108.3 | 14.6 | 31.95 | | | |

*Two Charpy specimens were taken and averaged.

TABLE 6B

| | | Tensile Data | | | | | | |
|---|---|---|---|---|---|---|---|---|
| | | Tensile Strength | 0.2% Offset Yield Strength | Elongation at break | Reduction of Area | Charpy V-Notch Impact Energy (ft-lbs) | | |
| Piece | Sample | (ksi) | (ksi) | (%) | (%) | 2C | 3C1 | 3C2 |
| B13B | 2T | 102.9 | 88.8 | 22.95 | 42.78 | 27 | 25 | 25 |
| B13B | 3T | 110.1 | 97 | 21.48 | 39.29 | | | |
| B14B | 2T | 106.9 | 94.1 | 22.15 | 40.13 | 24 | 33 | 29 |
| B14B | 3T | 103.6 | 88.3 | 22.88 | 42.44 | | | |
| B23B | 2T | 115.8 | 104.3 | 17.3 | 33.06 | 19 | 16 | 16 |
| B23B | 3T | 112.7 | 102 | 16.36 | 36.64 | | | |
| B24B | 2T | 118 | 107.2 | 15.8 | 34.34 | 20 | 17 | 19 |
| B24B | 3T | 118.5 | 106.4 | 16.3 | 33.86 | | | |

The tensile strengths varied from 102 to 127 ksi. The yield strengths varied from 88 to 117 ksi. The elongation at break varied from 10% to 23%. The Charpy impact strengths varied from 10 to 33 ft-lbs. It is noted that in Table 6A, samples B14A/2T and B14A/3T conform to the requirements of Specification 7. To summarize, the examples of Tables 5 and 6 had a minimum tensile strength of 100 ksi, a minimum 0.2% offset yield strength of 85 ksi, and a minimum elongation at break of 10%. They also had a minimum Charpy V-Notch impact strength of 10 ft-lbs.

It will be appreciated that variants of the above-disclosed and other features and functions, or alternatives thereof, may be combined into many other different systems or applications. Various presently unforeseen or unanticipated alternatives, modifications, variations or improvements therein may be subsequently made by those skilled in the art which are also intended to be encompassed by the following claims.

The invention claimed is:

1. A drilling component made from a spinodally-hardened copper-nickel tin alloy and comprising:

a main body; and a first female connector extending into a first end of the main body and a second female connector extending into a second end of the main body, wherein the first female fconnector extending into the first end and the second female connector extending into the second end are threaded connectors;

wherein the drilling component is an outer component for a drill string; and wherein the drilling component has an elongation at break of at least 10%.

2. The drilling component of claim 1, wherein the spinodally-hardened copper-nickel-tin alloy comprises from about 8 to about 20 wt % nickel, and from about 5 to about 11 wt % tin, the remaining balance being copper.

3. The drilling component of claim 1, wherein the spinodally-hardened copper-nickel-tin alloy comprises about 14.5 wt % to about 15.5 wt % nickel, and about 7.5 wt % to about 8.5% tin, the remaining balance being copper.

4. The drilling component of claim 1, wherein the drilling component has been cold worked and then reheated.

5. The drilling component of claim 1, wherein the drilling component is a drill stem, a tool joint, or a drill collar.

6. The drilling component of claim 1, having an outer diameter of at least about 4 inches.

7. The drilling component of claim 1, having a length of 60 inches or less.

8. The drilling component of claim 1, having a bore that passes through the component from a first end to a second end of the component.

9. The drilling component of claim 8, wherein the bore has a diameter of about 2 inches or greater.

10. The drilling component of claim 8, wherein a sidewall of the component has a thickness of about 1.5 inches or greater.

11. The drilling component of claim 1, wherein the first female connector extending into the first end of the main body is configured to removably engage a threaded male end of a first drill string component and the second female connector extending into the second end of the main body is configured to removably engage a threaded male end of a second drill string component.

12. The drilling component of claim 1, having an ultimate tensile strength of at least 160 ksi and a 0.2% offset yield strength of at least 150 ksi.

13. The drilling component of claim 1, having an ultimate tensile strength of at least 120 ksi and a 0.2% offset yield strength of at least 110 ksi; wherein the elongation at break is at least 15%.

14. The drilling component of claim 1, having an ultimate tensile strength of at least 106 ksi and a 0.2% offset yield strength of at least 95 ksi; wherein the elongation at break is at least 18%.

15. The drilling component of claim 1, having an ultimate tensile strength of at least 100 ksi and a 0.2% offset yield strength of at least 85 ksi.

16. The drilling component of claim 15, having a Charpy V-Notch impact strength of at least 10 ft-lbs.

17. A drilling string comprising:

a first component;

a second component; and a drilling string component comprising a spinodally-hardened copper-nickel-tin alloy and having a main body with a first female connector extending into a first end of the main body and a second female connector extending into a second end of the main body, wherein the first female connector extending into the first end and the second female connector extending into the second end are threaded connectors;

wherein the drilling string component has an elongation at break of at least 10%;

wherein the drilling string component connects the first component via the first female connector extending into the first end of the main body and the second component via the second female connector extending into the second end of the main body; and wherein a bore extends through the first component, the second component, and the drilling string component.

18. The drilling string of claim 17, wherein the spinodally-hardened copper-nickel-tin alloy of the drilling string component comprises from about 8 to about 20 wt % nickel, and from about 5 to about 11 wt % tin, the remaining balance being copper.

19. The drilling string of claim 17, wherein the first female connector extending into the first end of the main body is configured to removably engage a threaded male end of the first component and the second female connector extending into the second end of the main body is configured to removably engage a threaded male end of the second component.

20. A drilling component made from a spinodally-hardened copper-nickel tin alloy and comprising:

a main body; and a first female connector extending into a first end of the main body and a second female connector extending into a second end of the main body, wherein the first female connector extending into the first end and the second female connector extending into the second end are threaded connectors;

wherein the drilling component is an outer component for a drill string;

wherein the spinodally-hardened copper-nickel-tin alloy comprises about 14.5 wt % to about 15.5 wt % nickel, and about 7.5 wt % to about 8.5% tin, the remaining balance being copper;

wherein the drilling component has an ultimate tensile strength between 102 to 117 ksi, a yield strength between 88 to 106 ksi, an elongation at break between 13 to 26%, and a Charpy impact strength between 13 to 40 ft-lbs.

* * * * *